US007025118B2

(12) United States Patent
Streubel et al.

(10) Patent No.: US 7,025,118 B2
(45) Date of Patent: Apr. 11, 2006

(54) METHOD AND DEVICE FOR CONTINUOUSLY CASTING INGOTS, SLABS OR THIN SLABS

(75) Inventors: Hans Streubel, Erkrath (DE); Axel Weyer, Wuppertal (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/476,361

(22) PCT Filed: May 2, 2002

(86) PCT No.: PCT/EP02/04801

§ 371 (c)(1),
(2), (4) Date: Oct. 28, 2003

(87) PCT Pub. No.: WO02/090019

PCT Pub. Date: Nov. 14, 2002

(65) Prior Publication Data

US 2004/0129405 A1 Jul. 8, 2004

(30) Foreign Application Priority Data

May 7, 2001 (DE) ..... 101 22 118

(51) Int. Cl.
*B22D 11/12* (2006.01)

(52) U.S. Cl. ..... 164/454; 164/484

(58) Field of Classification Search ..... 164/454, 164/413, 441, 484, 442
See application file for complete search history.

(56) References Cited

U.S. PATENT DOCUMENTS

| | | | | |
|---|---|---|---|---|
| 5,577,548 | A | 11/1996 | Hohenbichler et al. | |
| 5,853,043 | A * | 12/1998 | Takeuchi et al. | 164/476 |
| 6,102,101 | A * | 8/2000 | Hanazaki et al. | 164/452 |
| 6,612,364 | B1 * | 9/2003 | Streubel | 164/476 |
| 6,701,999 | B1 * | 3/2004 | Von Wyl et al. | 164/484 |
| 6,712,123 | B1 * | 3/2004 | Weyer et al. | 164/454 |

FOREIGN PATENT DOCUMENTS

| | | |
|---|---|---|
| DE | 41 38 740 | 5/1993 |
| DE | 199 03 928 | 5/2000 |
| EP | 0 834 364 | 4/1998 |

* cited by examiner

*Primary Examiner*—Len Tran
(74) *Attorney, Agent, or Firm*—Herbert Dubno

(57) ABSTRACT

A continuously cast strand is subjected to soft reduction between the guide rollers below the mold and between the soft reduction stretch and the mold the strand is subjected to format or thickness reduction between at least one pair of position controlled guide rollers so that independently of the quality of the steel, the casting speed and the spray cooling, the position of the type of the mold cavity and hence the molten steel therein is maintained constant along the soft reduction stretch.

5 Claims, 1 Drawing Sheet

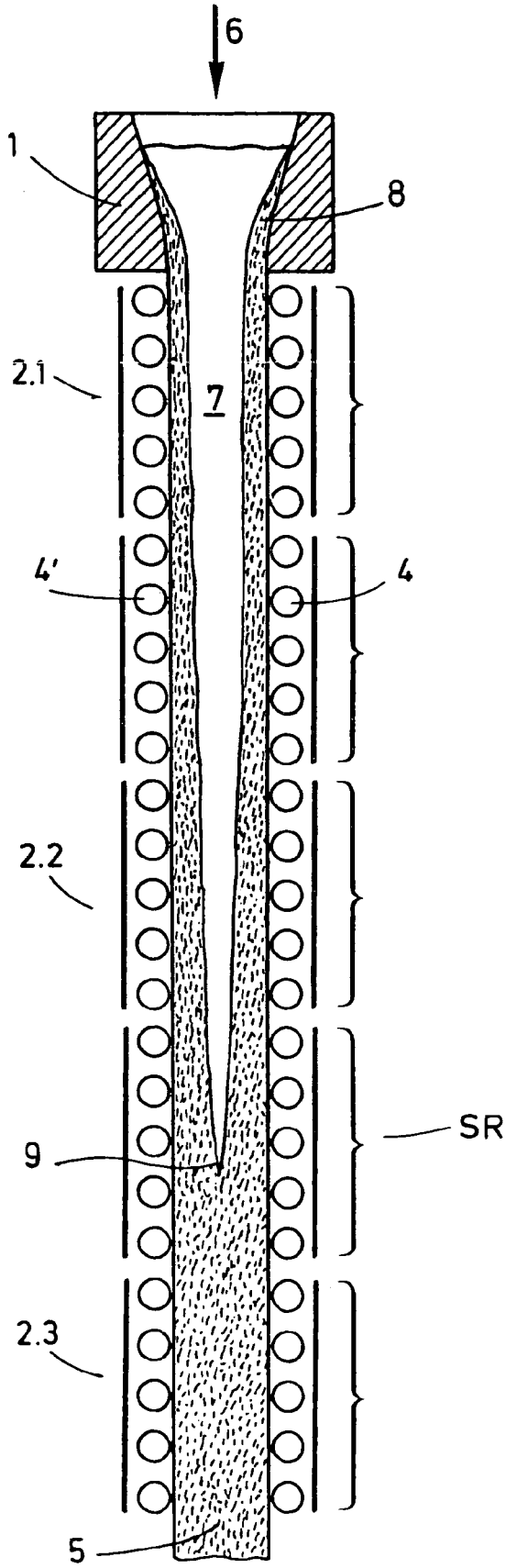
6
1
8
2.1
7
4'
4
2.2
SR
9
2.3
5

METHOD AND DEVICE FOR CONTINUOUSLY CASTING INGOTS, SLABS OR THIN SLABS

CROSS REFERENCE TO RELATED APPLICATIONS

This application is a national stage of PCT/EP02/04801 filed 2 May 2002 and is based upon German national application 101 22 118.5 of 7 May 2001 under the International Convention.

FIELD OF THE INVENTION

The invention relates to a method of continuous casting of blooms, ingots, billets, slabs or thin slabs in a continuous casting plant which has, beneath a mold, roll pairs which are actuated for example by path-controlled or position-controlled hydraulic cylinders, in strand guide segments which have their mutual spacing adjustable, whereby the cast strand by a tapered setting of at least one of its strand guide segments is reduced in thickness over a soft-reducing stretch extending to a sump or melt-filled cavity tip and in the region of its liquid core is subjected by at least one roll pair to a size or thickness reduction between the mold and the soft-reduction stretch (SR stretch).

BACKGROUND OF THE INVENTION

In continuous casting plants for slabs, to reduce the core porosity and the core segregation, the soft reduction process (SR process), among others, is used.

In bloom, ingot and billet plants, the soft reduction is preferably effected in a straight-drive region. The precondition for an improvement of the internal structure quality is that the final solidification of the strand be effected in the soft reduction (SR) stretch which is set to be tapered or conical. A final solidification upstream or downstream of the SR stretch not only does not give rise to any improvement in the internal quality, but on occasion can result in a detriment to the internal quality.

The conical or tapered roll setting of the strand guide segments is effected either as a fixed setting by means of hydraulic cylinders and spacer members or as a flexible setting, for example with position-controlled hydraulic cylinders.

The so-called operating window of the continuous casting plant, for example the matching of the casting speed or another casting parameter, the intensity of the spray cooling or the steel quality is given by the number of SR roll pairs and the type of adjustment. With an increasing roll count, the operating window can be increased. This increase however is not in proportion to the increase in the capital cost. Furthermore the position of the sump tip or melt-cavity tip can only be influenced to a limited extent by the spray cooling.

In a known process according to the German Patent Document DE 41 38 740 A1, the strand can pass through a soft reduction stretch at whose entry the strand is not yet fully solidified but at whose end the strand is solidified throughout its thickness and for which, among other things, the casting speed is a significant operating parameter. In the region of final solidification, a thickness reduction is effected, for example for thin slabs, of between 0.5 and 3 mm per meter of the cast length. For this purpose in the soft reduction stretch, the roll pairs of individual segments are brought closer together to follow the shrinkage ratio of the strand so as to provide a compaction of the internal or lattice structure in the region of residual solidification and to bring about an improvement in the strand internal quality.

European Patent Document EP 0 834 364 A1 describes a method and a device for high speed continuous casting plants with a strand thickness reduction during the solidification, whereby after the so-called cast rolling, the strand cross section is linearly reduced over a minimum length of the strand travel directly below the mold, this being followed by further strand reduction over the remainder of the strand path, the "soft reduction" until immediately upstream of the final solidification or the sump or melt-cavity tip. Through these technological features of the method, the strand cross section reduction is so carried out that a critical deformation of the strand shell is not exceeded in consideration of the high casting speed and steel quality.

European Patent Document EP 0 17 77 96 B1 discloses a method of advancing and dressing straightening a cast strand in the straightening and outlet region of an arcuate continuous casting plant, whereby oppositely disposed rolls are biased by a spring force against the ferrostatic pressure of the cast strand and are adjustably spaced from one another during the casting process. In this manner a cast strand region of increased solidity is avoided and during the travel of the strand between opposing rolls the respective spring force can be reduced by a lower counter force.

The slabs or blooms produced in the continuous casting plants corresponding to the aforementioned documents serve as starting materials for rolling milled products for the production of plates or strip.

OBJECT OF THE INVENTION

The object of the invention is to match or increase the operating window of a continuous casting plant as to its variable casting parameters and by influencing the sump or melt-cavity tip position to obtain a comparatively uniform and optimal internal or lattice structure in the cast strand.

SUMMARY OF THE INVENTION

To achieve this object the number of roll pairs and their more or less narrow adjustment relative to one another in the region of the liquid core of the cast strand is matched to the casting speed to provide a flexible match of the casting process thereto and thereby a size thickness reduction of the cast strand with the liquid core so adjusted that independently of the steel quality, the intensity of the spray cooling and the casting speed, the position of the sump melt-cavity tip in the SR stretch is maintained approximately constant.

As a result, in spite of an increasing casting speed and/or altered spray cooling, for example, the format thickness is so reduced that the position of the sump tip melt cavity tip is held practically constant in the SR stretch. Thus within a large casting speed range with reduced mechanical and technological expenditure, a uniformly good internal quality of the cast strand is ensured.

As a consequence in spite of changing operating parameters during the casting process, a uniformly optimal lattice structure of the casting strand is produced and an unnecessarily increased loading of the rolls and their bearings within the strand guide is avoided. The working out of the process provides that the arrangement and/or setting of the roll pairs for the size thickness reduction in the region of the liquid core of the casting strand is determined by the measurements of the casting cross section or format cross section of the cast strand.

And finally the method according to the invention provides that the thickness reduction is undertaken directly upstream of the SR stretch.

As a result, a matching or enlargement of the operating window of the continuous casting plant to various casting parameters is achieved in an economical manner and, especially, the influence of the melt-cavity tip location is largely rendered independent from the casting parameters in the sense that the melt-cavity tip always lies in a segment of the SR stretch which contributes to the improvement of the internal quality of the cast strand as a consequence, over a large casting speed range a uniformly high quality cast strand structure is ensured with a low expenditure with respect to equipment and technology.

BRIEF DESCRIPTION OF THE DRAWING

Details, features and advantages of the invention are given in the following explanation of an embodiment schematically illustrated in the drawing.

The sole FIGURE shows in a purely diagrammatic illustration a strand guide below a mold with a configuration according to the invention as well as with a soft reduction stretch SR.

The part of the apparatus involving the strand guide according to the drawing has below the mold a first strand guide segment 2.1 for parallel strand guidance.

The strand 5, which is only sketched in its illustration below the melt inlet 6 into the mold 1, has an initial crust of the forming strand shell 8.

According to the invention the strand 5 in the region of its liquid core 7 between the mold 1 and the soft reduction stretch SR is subjected by at least one roll pair 4, 4' to a size reduction thickness reduction. The size or format reduction by the roll pair 4, 4' is followed by a strand guide segment 2.2 for the parallel strand guidance of the cast strand 5. The roll pairs 4, 4' are each actuated by respective path-controlled or position-controlled hydraulic cylinders, not shown in greater detail so that they can overcome the hydrostatic pressure of the melt and thus impart a local size reduction or thickness reduction in strand 5, e.g. 10 mm/m, in the casting direction upstream of the soft reduction stretch SR with a thickness reduction of for example 1 mm/m. In the casting direction below the soft reduction stretch, a further strand guide segment 2.3 for parallel strand guidance is arranged.

The number and setting of the roll pairs 4, 4' in the region of the liquid core 7 in the cast strand 5 enable a flexible matching of the casting process to the casting speed or a variation therein.

Because of the thickness reduction of the strand with the liquid core, the size dimensions are continuously so adjusted in dependence upon the casting parameters like casting speed, steel quality and casting temperature that the sump tip or melt-cavity tip 9 largely independently from the aforedescribed casting parameters lies in a segment of the SR stretch which contributes to the improvement in the internal quality of the casting strand. With increasing casting speed or reduced spray cooling, for example, the format thickness is so reduced that the position of the sump tip 9 is held practically constant in the SR stretch. Thus over a large casting speed range with low machine cost and technology expense, a uniformly good internal quality of the cast product is ensured.

The invention claimed is:

1. A method of continuously casting blooms, slabs or thin slabs comprising the steps of:

(a) introducing a steel melt into a mold shaped to produce a continuous strand emerging from a bottom of said mold and formed by a progressively solidifying shell of steel surrounding a core of the molten steel filling a melt cavity in said shell;

(b) spray cooling said strand as said strand emerges from said mold in a plurality of successive strand-guide segments each of which comprises a pair of mutually spaced sets of guide rollers receiving the strand between them, at least one of said segments spaced below said mold having the sets of guide rollers thereof tapering toward one another to form a soft-reduction stretch within which solidification of the strand is completed over the entire cross section of the strand and in which a tip of the melt cavity is formed; and (c) controlledly reducing a thickness of said strand between said soft-reduction stretch and said mold between rollers of at least one format-reducing roller pair so that independently of the quality of the steel, the casting speed and the spray cooling, the position of said tip along the soft-reduction stretch is maintained approximately constant.

2. The method defined in claim 1 wherein the thickness of the strand is controlledly reduced in step (c) between a plurality of said format-reducing roller pairs arranged and set based upon casting cross section of said strand.

3. The method defined in claim 1 wherein the thickness of the strand is controlledly reduced in step (c) by said format-reducing roller pair directly upstream of said soft-reduction stretch.

4. The method defined in claim 1 wherein the rollers of said format-reducing roller pair are set with position control.

5. The method defined in claim 1 wherein the rollers of said at least one of said segments spaced below said mold having the sets of guide rollers thereof tapering toward one another to form said soft-reduction stretch are provided with roller-position control.

* * * * *